US006447114B1

(12) United States Patent
Sunderrajan et al.

(10) Patent No.: US 6,447,114 B1
(45) Date of Patent: Sep. 10, 2002

(54) INK JET PRINTING METHOD

(75) Inventors: Suresh Sunderrajan; Sridhar Sadasivan, both of Rochester; Patrick J. Whittaker, Webster; John W. Janssen, Williamson, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/514,085

(22) Filed: Feb. 28, 2000

(51) Int. Cl.[7] ..... B41J 2/01
(52) U.S. Cl. ..... 347/105; 347/106; 428/195
(58) Field of Search ..... 428/195, 331, 428/332, 323; 347/105, 106

(56) References Cited

U.S. PATENT DOCUMENTS

| | | | | |
|---|---|---|---|---|
| 4,794,067 A | * | 12/1988 | Grasshoff et al. | 430/213 |
| 5,104,730 A | | 4/1992 | Misuda et al. | |
| 5,478,631 A | * | 12/1995 | Kawano et al. | 428/212 |
| 5,560,982 A | * | 10/1996 | Sato | 428/216 |
| 5,712,027 A | | 1/1998 | Ali et al. | |
| 5,858,555 A | * | 1/1999 | Kuroyama | 428/537.7 |
| 5,989,378 A | * | 11/1999 | Liu et al. | 156/241 |
| 6,003,989 A | * | 12/1999 | Chen et al. | 347/105 |
| 6,020,032 A | * | 2/2000 | Roman, Jr. et al. | 427/411 |
| 6,110,585 A | * | 8/2000 | Shaw-Klein | 428/341 |

FOREIGN PATENT DOCUMENTS

| | | | | |
|---|---|---|---|---|
| DE | 43 30 428 A1 | | 3/1994 | |
| EP | 450540 | * | 10/1991 | B41M/5/00 |
| EP | 0 869 010 A1 | | 10/1998 | |
| EP | 0 904 953 A1 | | 3/1999 | |

OTHER PUBLICATIONS

ACRONOL s–728 Product Bulletin, retrieved from BASF website (www.basf.com); site visited Sep. 9, 2001.*

HP Photosmart 1218 Product Bulleting, retrieved from Hewlett Packarg website (www.hp.com); site visited Sep. 9, 2001.*

* cited by examiner

*Primary Examiner*—Bruce H. Hess
*Assistant Examiner*—Michael E Grendzynski
(74) *Attorney, Agent, or Firm*—Harold E. Cole

(57) ABSTRACT

An ink jet printing method comprising the steps of:

a) providing an ink jet printer that is responsive to digital data signals;

b) loading the printer with an ink jet recording element comprising a substrate having thereon an image-receiving layer comprising an inorganic, anionic pigment, an organic, anionic binder and an organic, cationic mordant, and a porous overcoat layer located over the image-receiving layer, the porous overcoat layer comprising an inorganic pigment and an organic, anionic, binder, wherein the refractive index of the inorganic pigment in the overcoat layer is at least 0.05 refractive index units less than the refractive index of the inorganic, anionic pigment in the image-receiving layer;

c) loading the printer with an ink jet ink composition; and d) printing on the recording element using the ink jet ink in response to the digital data signals.

16 Claims, No Drawings

INK JET PRINTING METHOD

CROSS REFERENCE TO RELATED APPLICATIONS

Reference is made to commonly assigned, co-pending U.S. Pat. application Ser. Nos. 09/452,396 by Sadasivan et al., filed Dec.1, 1999 entitled "Ink Jet Printing Method"; and 09/513,629 Sunderrajan et al., filed concurrently herewith entitled "Ink Jet Recording Element":, the disclosures of which are hereby incorporated by reference.

FIELD OF THE INVENTION

This invention relates to an ink jet printing method. More particularly, this invention relates to an ink jet printing method that uses a recording element containing pigments.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically have poorer image quality but exhibit superior dry times.

The above-referred to U.S. application Ser. No.09/451,786 by Sadasivan et al. relates to a porous ink jet recording element comprising a substrate having thereon an image-receiving layer comprising an inorganic, anionic pigment, an organic, anionic binder and an organic, cationic mordant. While that ink jet recording element provides good image quality and last ink dry times, it would be desirable to improve the image quality. as measured by optical density.

U.S. Pat. No. 5,104,730 relates to an ink jet recording sheet comprising a substrate and porous ink absorbent layers formed upon the substrate, wherein the bottom layer is pseudo-boehmite and a binder and the top layer is a fine silica powder. However, there is a problem with this element in that the top layer has to be peeled-off after printing which reduces the image optical density.

It is an object of this invention to provide an ink jet printing method that uses a recording element that has a fast ink dry time. It is another object of this invention to provide an ink jet printing method that uses an ink jet recording element that has good image quality. It is another object of the invention to provide an ink jet printing method that uses an ink jet recording element that has improved gloss.

SUMMARY OF THE INVENTION

These and other objects are achieved in accordance with the invention which comprises an ink jet printing method comprising the steps of:

a) providing an ink jet printer that is responsive to digital data signals;

b) loading the printer with an inkjet recording element comprising a substrate having thereon an image-receiving layer comprising an inorganic, anionic pigment, an organic, anionic binder and an organic, cationic mordant, and a porous overcoat layer located over the image-receiving layer, the porous overcoat layer comprising an inorganic pigment and an organic, anionic, binder, wherein the refractive index of the inorganic pigment in the overcoat layer is at least 0.05 refractive index units less than the refractive index of the inorganic, anionic pigment in the image-receiving layer;

c) loading the printer with an ink jet ink composition; and d) printing on the recording element using the ink jet ink in response to the digital data signals.

The ink jet recording element produced by the method of the invention provides good image quality, fast ink dry times and improved gloss.

DETAILED DESCRIPTION OF THE INVENTION

The inorganic, anionic pigment in the image-receiving layer useful in the invention may be a kaolin clay, a calcined clay, calcium carbonate, titanium dioxide, talc or a silicate. In a preferred embodiment of the invention, the inorganic, anionic pigment used is a kaolin clay sold under the trade name Hydraglos® 92 (J.M. Huber Company). The amount of inorganic, anionic pigment used may range from about 50% to about 95% of the image-receiving layer.

The organic, anionic binder of either layer useful in the invention may be a styrene acrylic latex; a styrene butadiene latex, such as Styronal ® BN 4606X (BASF Corp.); a poly(vinyl alcohol); a poly(vinyl acetate), such as Vinac ® 884 (Air Products Inc.). a cellulosic or a polyurethane binder. In a preferred embodiment of the invention, a commercially-available styrene acrylic latex such as Acronal ® S-728 (BASF Corp.) is used in the image-receiving layer. In another preferred embodiment of the invention, a commercially-available poly(vinyl alcohol) such as Airvol ® 21-205 (Air Products Inc.) is used in the overcoat layer.

The organic, anionic binder may be used in an amount of from about 5% to about 20% of the image-receiving layer or overcoat layer. In general, good results are obtained when the ratio of pigment to binder is from about 5:1 to about 8:1.

The organic, cationic mordant useful in the invention may be a polymer latex dispersion or a water-soluble polymer solution. Examples of mordants useful in the invention are disclosed in U. S. Pat. No. 5,474,843, the disclosure of which is hereby incorporated by reference. Other useful mordants include cationic urethane dispersions sold under the trade name Witcobond® W-213 and Witcobond ® W-215 (Witco Corporation).

In a preferred embodiment of the invention, the organic, cationic mordant is:

M1: poly(N-vinyl benzyl-N-benzyl-N,N-dimethyl ammonium chloride-co-styrene-co-divinyl benzene), M2: poly(N-vinylbenzyl-N,N,N-trimethylammonium chloride-co-ethylene glycol dimethacrylate), or M3: poly(N-vinylbenzyl-N,N,N-trimethylammonium chloride-co-divinyl benzene).

In general, good results have been obtained when the mordant polymer is present in an amount of from about 1% to about 75% by weight of the image-receiving layer, preferably from about 10% to about 20%.

Smaller quantities of up to about 10% of other binders may also be added to the image-receiving layer such as poly(vinyl pyrrolidone) sold as Luviskol ® VA 64W (BASF Corp.) or poly(vinyl pyrrolidone-co-vinyl acetate) sold as Luviquat ® PQ11PN (BASF Corp.). In addition to the above major components, other additives such as pH-modifiers like nitric acid, cross-linkers, rheology modifiers, surfactants, UV-absorbers, biocides, lubricants, dyes, optical brighteners etc. may be added as needed.

As noted above, the refractive index of the inorganic pigment in the overcoat layer is at least 0.05, preferably between about 0.15 and 0.25, refractive index units less than the refractive index of the inorganic, anionic pigment in the image-receiving layer. This overcoat layer is generally optically clear and causes a reduction in light scattering by the recording element. A reduction in light scattering results in superior optical density and gloss.

The inorganic pigment useful in the overcoat layer used in the invention may be, for example, a silica (such as colloidal silica, fumed silica or silica gel), an alumina (an alumina oxide, an alumina hydrate or a pseudoboehmite), a calcium carbonate, a modified kaolin clay, a montmorillinite clay, a hydrotalcite clay or a laponite clay. In a preferred embodiment, the inorganic pigment is an alumina hydrate sold under the trade name Dispal® 23N4-80 (Condea Vista Company).

The amount of inorganic pigment used may range from about 50% to about 95% of the image-receiving layer.

The substrate may be porous such as paper or non-porous such as cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinvl acetate copolymer. can be applied to the surface of the support.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed. In a preferred embodiment, the image-receiving layer coating formulation would have a coating solids of 40–60% and a low shear (100 rpm Brookfield) viscosity of 500–2000 centiPoise. In another preferred embodiment, the overcoat layer coating formulation would have a coating solids of 20–40% and a low shear (100 rpm Brookfield) viscosity of 400–2000 centiPoise.

The image-receiving layer thickness may range from about 5 to about 60 $\mu$m, preferably from about 10 to about 30 $\mu$m. The overcoat layer thickness may range from about 2 to about 20 $\mu$m, preferably from about 4 to about 10 $\mu$m. The coating thickness required is determined through the need for the coating to act as a sump for absorption of ink solvent and the need to hold the ink near the coating surface.

After coating, the ink jet recording element may be subject to calendering or supercalendering to enhance surface smoothness. In a preferred embodiment, the ink jet recording element is subject to hot, soft-nip calendering at a temperature of about 65 ° C. and pressure of 14000 kg/m at a speed of from about 0.15 m/s to about 0.3 n/s.

The substrate used in the ink jet recording element used in the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil. various glass materials, and the like. The thickness of the substrate employed in the invention can be from about 12 to about 500 Mm, preferably from about 75 to about 300 $\mu$m.

Ink jet inks used to image the recording elements used in the present invention are well-known in the art. The ink compositions used in ink jet printing typically are liquid compositions comprising a solvent or carrier liquid, dyes or pigments humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example further illustrates the invention.

EXAMPLE

Control Element 1

A paper base of Nekoosa Solutions Smooth) ® (Georgia Pacific Co.), Grade 5128 (Carrara White ®, Color 9220), basis weight 150 g/m$^2$, was coated with an image-receiving layer as described in Table 1 below (dry grams). The coating was applied onto the paper base using a wire wound Meyer rod of wire diameter 0.51 $\mu$m with a wet laydown thickness of 40 $\mu$m. The element was air dried.

The image-receiving layer contains kaolin clay (I-lydragloss ® 92) and styrene acrylic latex which are both predominantly anionic. The layer also contains a mordant polymer M3 which is cationic. The coating formulation thus comprises a mixture of anionic and cationic materials. To achieve a stable formulation, it is necessary to minimize the anionic charge keeping the cationic charge constant. This is achieved by adjusting the pH of the kaolin clay and styrene acrylic latex using nitric acid. In order to achieve a stable formulation, the kaolin clay and styrene acrylic latex are added to the cationic Mordant M3 and then the pH is adjusted, using the method as described in copending U.S. patent application Ser. No. 09/451,809, by Sadasivan et al. (Docket 80215), entitled "Method of Preparing a Stable Coating", the disclosure of which is hereby incorporated by reference.

Control Element 2

A portion of Control Element 1 was overcoated with an overcoat layer as described in Table 1 using a 15 ml syringe-coater with a pre-metered application rate of 6 cc/min over a 1.07 m long substrate and air dried. The overcoat formulation was kaolin clay (Digitex ®) 1000), dispersed in water to form a 30% solids solution, and poly(vinyl alcohol) as described in Table 1.

Element 1 of the Invention

This element is similar to Control Element 2 except that alumina hydrate is added to the overcoat layer as described in Table 1.

Following are the substitutes of the layers in the above elements:

TABLE 1

| | Substituents (Dry Grams) | | | | |
|---|---|---|---|---|---|
| | Control Element 1 | Control Element 2 | | Element 1 of Invention | |
| Substituent | Image Receiving layer | Image Receiving Layer | Over-coat Layer | Image Receiving Layer | Over-coat Layer |
| Kaolin clay (Hydragloss ® 92) as a dry powder | 100 | 100 | — | 100 | — |
| Mordant M3 as a 15 % solids dispersion | 30 | 30 | — | 30 | — |
| Styrene acrylic latex (Acronal ® S728) as a 50% solids dispersion | 10 | 10 | — | 10 | — |
| Nitric Acid (1N) | 1.0 | 1.0 | — | 1.0 | — |
| Kaolin Clay (Digitex ® 1000) as a dry powder | — | — | 100 | — | — |
| Alumina hydrate (Dispal ® 23N4-80) as a dry powder | — | — | — | — | 100 |
| Poly (vinyl alcohol) (Airvol ® 21-205) as a 21% solids dispersion | — | — | 10 | — | 10 |

Refractive Index

The refractive indices of the pigments used in the Example are as follows:

TABLE 2

| Pigment | Refractive Index |
|---|---|
| Kaolin clay (Hydragloss ® 92) as a dry powder used in image-receiving layer | 1.7 |
| Kaolin Clay (Digitex ® 1000) as a dry powder used in overcoat layer in Control Element 2 | 1.7 |
| Alumina hydrate (Dispal ® 23N4-80) as a dry powder used in overcoat layer in Element 1 of the Invention | 1.5 |

Printing

Samples from each of the above elements were printed using a Hewlett Packard Photosmart ® printer with printer settings at "photoglossy paper, best". The inks used were Hewlett Packard Photosmart ® inks. A striped target was printed comprising 100% coverage of yellow, cyan, and magenta, 200% coverage for red, green, and blue, and 300% coverage for black in areas of 1 cm by 23 cm. The black stripe was tested for dry time and optical density.

Dry Time and Optical Density

Dry time, defined as the time after printing at which no ink retransfers from the printed element to a blotting sheet is observed, was measured using a blotting technique. Immediately after printing, each element was placed on a foam base, a piece of copy paper placed on top, and a weighted smooth rod was rolled over the copy paper. The copy paper was then taken off and examined for retransfer.

The results in Table 3 are given ratings from 1–5, where 1 corresponds to no transfer (fast dry time) to the copy paper, and 5 corresponds to complete transfer (the whole stripe is visible on the copy paper).

Optical density of the printed recording elements was measured using a X-Rite ® model 820 transmission/reflection densitometer with status A filtration. The black stripe on the target was tested. The results arc the average of three measurements.

The following results were obtained:

TABLE 3

| Element | Dry time | Optical Density |
|---|---|---|
| Control 1 | 1 | 1.61 |
| Control 2 | 1 | 1.48 |
| Invention 1 | 1 | 2.08 |

The above results show that the Element 1 of the invention has a higher optical density as compared to the Control Elements 1 and 2 while maintaining a fast dry time.

Gloss

The gloss of the above recording elements was measured using a Gardner Tri-gloss meter at the 60-degree setting according to the ASTM D523 standard. The following results were obtained:

TABLE 4

| Element | Gloss |
|---|---|
| Control 1 | 8.8 |
| Control 2 | 9.1 |
| Invention 1 | 26.5 |

The above results show that Element 1 of the invention had a higher gloss as compared to Control Elements 1 and 2.

This invention has been described with particular reference to preferred embodiments thereof but it will be understood that modifications can be made within the spirit and scope of the invention.

What is claimed is:

1. An ink jet printing method comprising the steps of:

a) providing an ink jet printer that is responsive to digital data signals;

b) loading said printer with an ink jet recording element comprising a substrate having thereon an image-receiving layer comprising an inorganic, anionic pigment, an organic, anionic binder and an organic, cationic mordant, and a porous overcoat layer located over said image-receiving layer, said porous overcoat layer comprising an inorganic pigment and an organic, anionic, binder, wherein the refractive index of said inorganic pigment in said overcoat layer is at least 0.05 refractive index units less than the refractive index of said inorganic, anionic pigment in said image-receiving layer;

c) loading said printer with an ink jet ink composition; and d) printing on said recording element using said ink jet ink in response to said digital data signals.

2. The ink jet printing method of claim 1 wherein said inorganic, anionic pigment in said image-receiving layer is a kaolin clay, a calcined clay, calcium carbonate, titanium dioxide, talc or a silicate.

3. The ink jet printing method of claim 1 wherein said inorganic, anionic pigment in said image-receiving layer is a kaolin clay.

4. The ink jet printing method of claim 1 wherein said inorganic, anionic pigment in said imagc-receiving layer is present in an amount of from about 50% to about 95% of said image-receiving layer.

5. The ink jet printing method of claim 1 wherein each said organic, anionic binder independently is a styrene acrylic latex, a styrenc butadiene latex, a poly(vinyl alcohol), or a poly(vinyl acetate).

6. The ink jet printing method of claim 1 wherein said organic, anionic binder in said image-receiving layer is a styrene acrylic latex.

7. The ink jet printing method of claim 1 wherein said organic, anionic binder in said image-receiving layer is present in an amount of from about 5% to about 20% of said image-receiving layer.

8. The ink jet printing method of claim 1 wherein said organic, anionic binder in said overcoat layer is poly(vinyl alcohol).

9. The ink jet printing method of claim 1 wherein said organic, anionic binder in said overcoat layer is present in an amount of from about 5% to about 20% of said overcoat layer.

10. The ink jet printing method of claim 1 wherein said organic, cationic mordant is a polymer latex dispersion. a water-soluble polymer solution or a cationic urethane dispersion.

11. The ink jet printing method of claim 1 wherein said organic, cationic mordant is poly(N-vinyl benzyl-N-benzyl-N,N-dimethyl ammonium chloride-co-styrene-co-divinyl benzene); poly(N-vinylbcnzyl-N,N,N-trimethylammonium chloride-co-ethylene glycol dimethacrylate); or poly(N-vinylbenzyl-N,N,N-trimethylammonium chloride-co-divinyl benzene).

12. The ink jet printing method of claim 1 wherein said organic, cationic mordant is poly(N-vinylbenzyl-N,N,N-trimethylammonium chloride-co-divinyl benzene).

13. The ink jet printing method of claim 1 wherein said mordant is present in an amount of from about 1% to about 75% by weight of said image-receiving layer.

14. The ink jet printing method of claim 1 wherein said inorganic pigment in said overcoat layer is a silica, an alumina, a calcium carbonate, a modified kaolin clay, a montmorillinite clay, a hydrotalcite clay or a laponite clay.

15. The ink jet printing method of claim 1 wherein said inorganic pigment in said overcoat layer is an alumina.

16. The ink jet printing method of claim 1 wherein said inorganic pigment in said overcoat layer is present in an amount of from about 50% to about 95% of said overcoat layer.

* * * * *